US006182860B1

(12) United States Patent
Ruhl et al.

(10) Patent No.: US 6,182,860 B1
(45) Date of Patent: Feb. 6, 2001

(54) SOAP LEAF DISPENSER

(75) Inventors: Carl P. Ruhl, Pickerington, OH (US); Theodore J. Pierson, Denville, NJ (US)

(73) Assignee: Bath & Body Works, Inc., Reynoldsburg, OH (US)

( * ) Notice: Under 35 U.S.C. 154(b), the term of this patent shall be extended for 0 days.

(21) Appl. No.: 09/343,380

(22) Filed: Jun. 30, 1999

(51) Int. Cl.[7] ..... A47F 1/04; G07F 11/00

(52) U.S. Cl. ..... 221/154; 221/306; 221/309; 206/39; 206/39.5

(58) Field of Search ..... 221/62, 63, 154, 221/306, 309; 206/39, 39.5, 823

(56) References Cited

U.S. PATENT DOCUMENTS 2,346,488 * 4/1944 Hoffmaster et al. ..... 206/39 X
2,557,323 * 6/1951 Testi ..... 206/39.5 X
3,286,823 * 11/1966 Gillespie ..... 206/39.5 X
3,421,658 * 1/1969 Cooksey ..... 206/39 X
4,170,914 * 10/1979 Carrier ..... 206/39 X
5,161,711 * 11/1992 Picozza et al. ..... 220/282 X
5,688,394 * 11/1997 McBride, Jr. et al. ..... 221/63 X

* cited by examiner

*Primary Examiner*—H. Grant Skaggs
*Assistant Examiner*—Gene O. Crawford
(74) *Attorney, Agent, or Firm*—Notaro & Michalos P.C.

(57) ABSTRACT

A dispenser for dispensing individual leaves of soap from a stack of leaves stored in the dispenser, includes top and bottom plastic case portions which are connected to and aligned by four pins extending from one container half into holes in the other container half. The pins are held in the holes by friction to hold the case portions together. A tool is used in a pry slot formed at the sides of the dispenser between the case portions, to pry the halves apart and open the case for replenishing the supply of leaves. The dispenser has an outlet slot with a length and width selected for dispensing one leaf at a time. A finger opening exposes part of the top surface of the stack near the outlet slot and is covered by reusable adhesive tape. The tape is partly removed to expose the finger opening and outlet slot so that a finger can contact the top leaf and eject it through the slot. The outlet slot has an upper lip overhang, over a lower lip of the outlet slot.

12 Claims, 2 Drawing Sheets

SOAP LEAF DISPENSER

FIELD AND BACKGROUND OF THE INVENTION

The present invention relates in general to dispensers, and in particular to a new and useful soap leaf dispenser for dispensing thin leaves of soap.

The presence of a slot in a dispenser to allow a finger to touch the top of a first sheet in a stack of sheets to dispense one sheet from a container has been used in many different environments and for many different purposes. See for example U.S. Pat. No. 1,815,083 to Weinberg.

A dispenser, which can open to replenish its content is also well known as evidenced by U.S. Pat. No. 2,269,525 to Fleischer.

Containers which are based on cosmetic cases are also known. One example is U.S. Pat. No. 4,018,237 to Steiman. Also see U.S. Pat. No. 4,913,311 to Garcia.

Mechanical dispensers for soap leaves are also known. See for example U.S. Pat. No. 4,286,731 to Hettinga. Self sealing dispenser packs to avoid entry of liquid are also known and exemplified by U.S. Pat. No. 4,735,317 Sussman, et al.

Other patents show other examples of dispensers for dispensing thin sheet-like materials such as razor blades, credit cards and the like, or other uses for cosmetic compact type containers.

The most pertinent patents know to the applicants are:

| U.S. Pat. No. | Inventor(s) |
|---|---|
| 1,815,083 | Weinberg |
| 2,269,525 | Fleischer |
| 2,346,488 | Hoffmaster, et al. |
| 2,557,323 | Testi |
| 3,109,538 | Boxer |
| 4,018,237 | Steiman |
| 4,170,914 | Carrier |
| 4,240,564 | Pritchard |
| 4,265,366 | Schillinger, et al. |
| 4,286,731 | Hettinga |
| 4,735,317 | Sussman, et al. |
| 4,739,902 | Joslyn, et al. |
| 4,770,320 | Miles, et al. |
| 4,826,014 | Schefer |
| 4,887,739 | Parker |
| 4,907,825 | Miles, et al. |
| 4,913,311 | Garcia |
| 5,080,223 | Mitsuyama |
| 5,125,505 | Kurosaki |
| 5,154,292 | Bartucca, et al. |
| 5,409,133 | Gringer |
| 5,417,345 | Smith |
| 5,560,476 | Lee |
| 5,718,329 | Ippolito, et al. |
| 5,730,319 | Gray, et al. |
| 5,755,356 | Bastiaens, et al. |
| 5,848,723 | Krautsack |

SUMMARY OF THE INVENTION

The present invention is a plastic dispenser for dispensing individual leaves of soap or other consumable leaves from a stack of leaves stored in the dispenser. The dispenser includes top and bottom plastic halves or case portions which are connected to and aligned with each other by four pins extending from one container half into holes in the other container half. The pins are held in the holes by friction to hold the case portions or halves together. A coin is used in a pry slot formed at the sides of the dispenser between the case portions, to pry the two halves apart and open the case for replenishing the supply of soap leaves in the dispenser.

One edge of the dispenser has an outlet slot with a length and width selected for dispensing one leaf at a time. A curved finger opening which exposes the top surface of the stack of leaves near the outlet slot, is covered by a piece of reusable adhesive tape for protecting the soap and keeping the leaves in the dispenser. The tape is partly removed to expose the finger opening and outlet slot and then the user can use her or his finger to contact the top leaf and eject the top leaf through the slot.

The outlet slot is designed with the upper dispenser half, which is also preferably transparent to view the supply of leaves in the dispenser, having an upper lip overhang, over a lower lip of the outlet slot. The lower lip also includes an inner raised, continuous or interrupted rail to help the top leaf slid through the outlet slot. In this way, any water droplets which fall onto the upper dispenser half will drip off the edge of the upper lip without getting into the outlet slot and thus destroying the very water sensitive stack of soap leaves in the dispenser. This water-shedding design feature is in addition to the peel-off tape feature for the dispenser.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
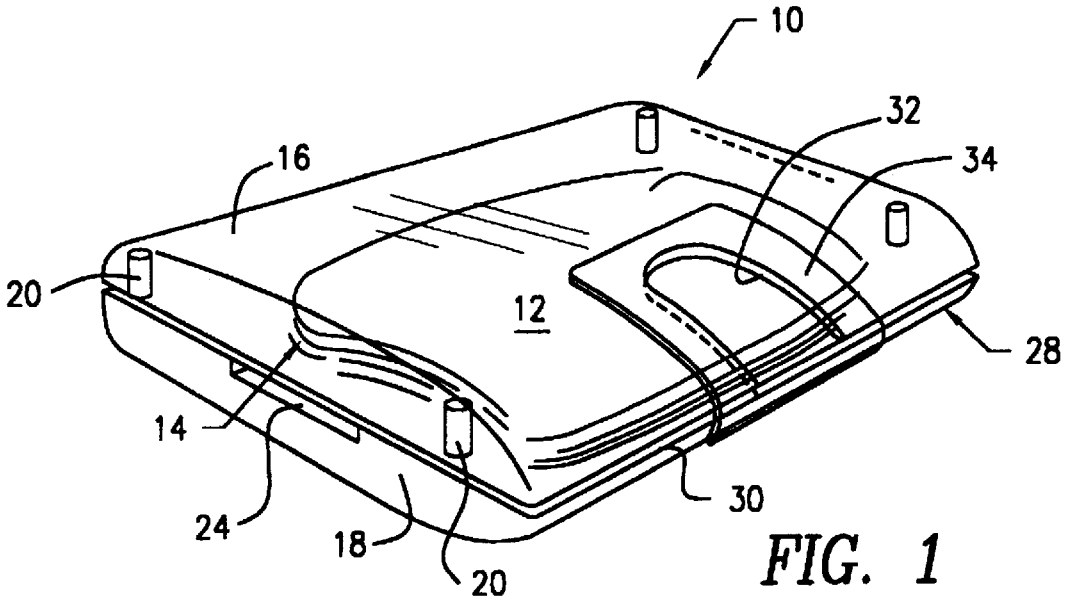
FIG. 1 is a perspective view of soap leaf dispenser for dispensing thin leaves of soap according to the present invention.

Referring to the drawings, the invention embodied in FIGS. 1–5, comprises a plastic dispenser 10 for dispensing individual leaves of soap 12 from a stack of leaves 14 stored in the dispenser. The dispenser includes transparent plastic top case portion 16 and an opaque plastic bottom case portion 18. The case portions are connected to and aligned with each other by four pins 20 extending from the top container half 16 near the four corners of the substantially rectangular case, into four holes 22 in the other container half 18. The pins are held in the holes by friction to hold the case portions or halves together.

A coin can be used in a pry slot 24 formed at the sides of the bottom case portion, at the top of the bottom case portion next to the bottom of the top case portion 16. The coin or other tool is used to pry the two halves apart and open the case for replenishing the supply of soap leaves in the dispenser. Back and side walls 26,27 are formed in the interior of one or both case halves 16,18, to closely enclose the leaf stack 14 and keep the leaves aligned in a neat stack in the case. Back wall 26 is particularly important in that is conforms to the shape of the back edges of the leaves 12 in stack 14 to keep the leaves in this neat stack ready to be dispensed, one at a time. For this reason curved wall 26 should be tall enough to engage the full height of stack 14.

The front side 28 of the dispenser 10 has an outlet slot 30 defined between the case portions 16,18, with a length of about 3 inches and width W of about 0.04 inches. These dimensions which can be from about 1 to 6 inches for the width and about 0.02 to 0.10 inches for the width depending on the size of the dispenser and the size of leaves to be dispensed, are selected for dispensing one leaf at a time.

A curved finger opening 32 in the top case portion 16, is sized and positioned to exposes part of the top surface of the stack of leaves 14 near the outlet slot 30. For storage and before use, opening 32 is covered by a piece of reusable adhesive tape 34 for protecting the soap and keeping the leaves in the dispenser from exiting the slot 30. The tape is partly removed to expose the finger opening 32 and outlet slot 30 and then the user can use her or his finger to contact the top leaf and slide the top leaf 12, out through the slot 30.

The outlet slot is designed with the upper dispenser half 16 having an upper lip 36 with a sharp-angled or cornered front lower edge 39, and which overhangs by a distance A, over a lower lip 38 of the outlet slot 30.

Figure 2:
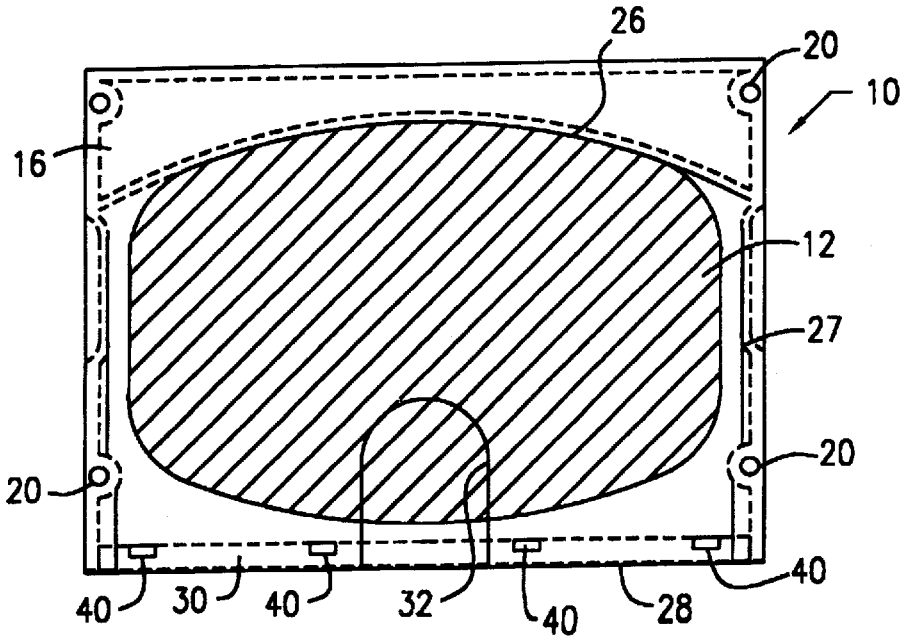
FIG. 2 is a top plan view thereof.
Figure 3:
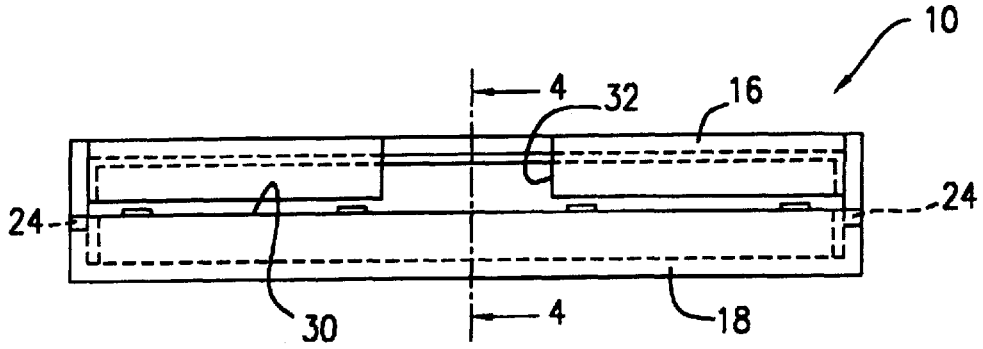
FIG. 3 is a front elevational view thereof.

That is, upper lip 36 extends beyond lower lip 38 by the selected distance A. The lower lip 38 also includes an upper surface with one or more inner, raised, continuous or interrupted rails or raised projections 40 to help the top leaf slide through the outlet slot 30 when pushed by a finger, but for retaining the leaves in the dispenser against accidentally exiting the dispenser. As shown in FIG. 2, four spaced short rails 40 can be used on lip 38 in outlet slot 30.

The lip overhang A, and to some extent, the rail or rails 40, help divert any water droplets which fall onto the upper dispenser portion from entering the slot 30. Instead the water tends to drip off the edge of the upper lip without getting into the outlet slot and thus destroying the very water sensitive stack of soap leaves 14 in the dispenser 10. This water-shedding design feature is in addition to the peel-off tape cover 34 for the dispenser. Overhang A is about 0.015 inches or from about 0.005 to 0.03 inches.

Any type of plastic which is suitable for cosmetic compacts and the like, and which is well know to those skill in this art, can be used for the case portions 16 and 18. The soap leaves 12 are available commercially and can be supplied or cut to size for inclusion in the dispenser. Pins 20 may be all plastic, or plastic with metal inserts for strength.

Figure 5:
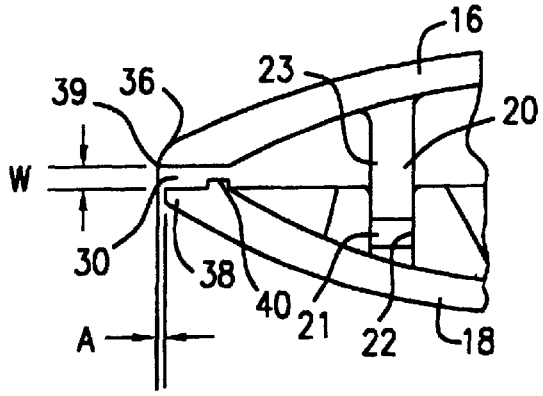
FIG. 5 is an enlarged detail view of the outlet slot area of the dispenser.

Alternatively, each pin 20 shown in FIG. 5, has a large diameter plastic portion 23 and a small diameter plastic portion 21, with the diameter of hole 22 being intermediate that of portions 21 and 23. In this way the small diameter portions are loosely inserted into holes 22 to help align the case portions to each other. Then the case portions are pressed together, friction fitting the large diameter portions 23 which are slightly larger in diameter that holes 22, into the respective holes 22, to removably but firmly secure the case portions to each other.

Instead of pins, the openable connecting means between the case portion may be a hinge structure or a snap connection of known design.

Figure 4:
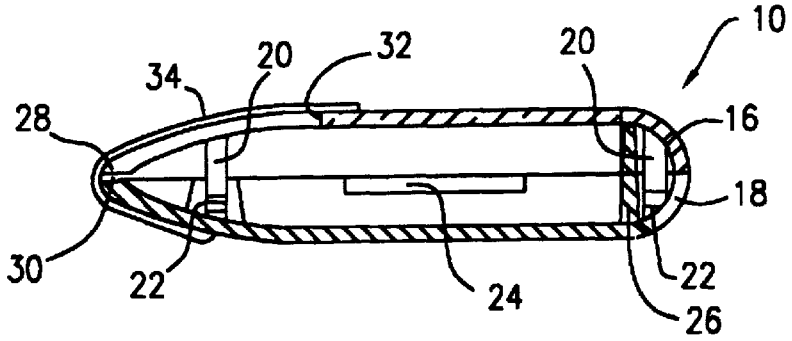
FIG. 4 is a side sectional view thereof, taken along line 4—4 of FIG. 3.

Curved wall 26 is molded as part of bottom case portion 18 and extends to the inner surface of top case portion 16 as shown in FIG. 4. Both case portions are made of transparent plastic in the preferred form of the invention.

Although the preferred embodiment of the invention is used for dispensing soap leaves, any other type of consumable leave can also be dispenses, such as fragrance carrying leaves, cosmetic leaves and other like leaf products.

While a specific embodiment of the invention has been shown and described in detail to illustrate the application of the principles of the invention, it will be understood that the invention may be embodied otherwise without departing from such principles.

What is claimed is:

1. A dispenser for dispensing individual consumable and water sensitive leaves from a stack of leaves stored in the dispenser, comprising:

a top case portion;

a bottom case portion;

openable connecting means between the case portions for connecting and aligning the case portions to each other in a closed position defining a volume for containing a stack of leaves, and being openable for separating the case portions from each other for replenishing the stack of leaves;

the dispenser in the closed position having one side with an outlet slot of a length and width for dispensing one leaf at a time;

the top case portion having a finger opening which exposes part of a top surface of the stack of leaves near the outlet slot;

the top case portion having an upper lip overhang at the outlet slot, which overhangs and extends beyond a lower lip of the bottom case portion by a selected amount (A), the upper lip having a sharp-angled front lower edge so that water droplets which may fall onto the top case portion drip off the front lower edge of the upper lip without entering the outlet slot;

at least one inner raised rail on the lower lip and in the outlet slot; and a stack of individual consumable water-sensitive leaves in the dispenser between the top and bottom case portions.

2. A dispenser according to claim 1, wherein the connecting means comprises at least one pin extending from one of the case portions toward the other case portion, and a hole in the other case portion for receiving the pin and for holding the pin by friction to hold the case portions together in the closed position.

3. A dispenser according to claim 1, including a pry slot formed at a side of the dispenser between the case portions for use with a tool for opening the connecting means by prying the case portions apart.

4. A dispenser according to claim 1, including a reusable adhesive tape over the finger opening for protecting the stack of leaves and for keeping the leaves in the dispenser.

5. A dispenser according to claim 1, including a plurality of said inner raised rails spaced on the lower lip and in the outlet slot, said selected amount (A) being about 0.005 to 0.03 inches.

6. A dispenser according to claim 1, including a curved back wall in the dispenser for aligning the stack of leaves.

7. A dispenser according to claim 1, wherein the top case portion is transparent plastic and the bottom case portion is plastic.

8. A dispenser according to claim 1, wherein the edge of the upper lip comprises a sharp corner at the outlet slot.

9. A dispenser according to claim 1, wherein the connecting means comprises at least one pin extending from one of the case portions toward the other case portion, and a hole in the other case portion for receiving the pin and for holding the pin by friction to hold the case portions together in the closed position, the pin being at least partly made of metal.

10. A dispenser according to claim 1, wherein the connecting means comprises at least one pin extending from one of the case portions toward the other case portion, and a pin hole in the other case portion for receiving the pin and for holding the pin by friction to hold the case portions together in the closed position, the pin having a large diameter portion and a small diameter portion, with a diameter of the pin hole being intermediate that of the large and small diameter portions of the pin so that the small diameter portions can be loosely inserted into the pin hole to help align the case portions to each other and the case portions can then be pressed together, friction fitting the large diameter portion into the pin hole to removably but firmly secure the case portions to each other.

11. A dispenser according to claim 1, wherein the bottom case portion has a curved back wall in the dispenser for aligning the stack of leaves, the back wall extending to an inner surface of the top case portion.

12. A dispenser according to claim 11, wherein the top and bottom case portions are transparent plastic.

* * * * *